US008896583B2

(12) United States Patent
Xue et al.

(10) Patent No.: US 8,896,583 B2
(45) Date of Patent: Nov. 25, 2014

(54) COMMON ELECTRODE DRIVING METHOD, COMMON ELECTRODE DRIVING CIRCUIT AND LIQUID CRYSTAL DISPLAY

(75) Inventors: Hailin Xue, Beijing (CN); Yubo Xu, Beijing (CN); Cheng Li, Beijing (CN); Hongming Zhan, Beijing (CN); Jidong Zhang, Beijing (CN)

(73) Assignee: Beijing BOE Optoelectronics Technology Co., Ltd., Beijing (CN)

( * ) Notice: Subject to any disclaimer, the term of this patent is extended or adjusted under 35 U.S.C. 154(b) by 285 days.

(21) Appl. No.: 13/376,495

(22) PCT Filed: Apr. 18, 2011

(86) PCT No.: PCT/CN2011/072939

§ 371 (c)(1), (2), (4) Date: Dec. 6, 2011

(87) PCT Pub. No.: WO2011/127841

PCT Pub. Date: Oct. 20, 2011

(65) Prior Publication Data

US 2012/0092312 A1 Apr. 19, 2012

(30) Foreign Application Priority Data

Apr. 16, 2010 (CN) ..... 2010 1 0152188

(51) Int. Cl.
*G09G 3/36* (2006.01)

(52) U.S. Cl.
CPC ..... *G09G 3/3659* (2013.01); *G09G 3/3655* (2013.01); *G09G 2320/0219* (2013.01)
USPC ..... 345/205; 345/87; 345/93; 345/96

(58) Field of Classification Search
CPC ..... G09G 3/3655; G09G 3/3696
USPC ..... 345/87–100, 208
See application file for complete search history.

(56) References Cited

U.S. PATENT DOCUMENTS

2001/0017611 A1* 8/2001 Moriyama ..... 345/100
2002/0154084 A1 10/2002 Tanaka et al.

(Continued)

FOREIGN PATENT DOCUMENTS

CN 1383497 A 12/2002
CN 1922647 A 2/2007

(Continued)

OTHER PUBLICATIONS

International Search Report: mailed Jul. 14, 2011; PCT/CN2011/072939.

(Continued)

*Primary Examiner* — Srilakshmi K Kumar
*Assistant Examiner* — James Nokham
(74) *Attorney, Agent, or Firm* — Ladas & Parry LLP

(57) ABSTRACT

A common electrode driving method, comprises: generating a first common electrode signal to be applied to a storage electrode line of each row of pixels on an array substrate, and a second common electrode signal to be applied to a common electrode forming a liquid crystal capacitance with pixel electrodes of each row of pixels on the array substrate, the first common electrode signal being opposite to a gate signal for gate electrodes applied to the corresponding row of pixels in terms of transition timing; and inputting the first common electrode signal to each row of pixels, and inputting the second common electrode signal to the common electrode.

14 Claims, 2 Drawing Sheets

(56) References Cited

U.S. PATENT DOCUMENTS

| | | | | |
|---|---|---|---|---|
| 2005/0035938 | A1 | 2/2005 | Noda | |
| 2005/0259062 | A1 | 11/2005 | Senda et al. | |
| 2005/0264509 | A1 | 12/2005 | Senda et al. | |
| 2006/0119756 | A1 | 6/2006 | Shin et al. | |
| 2006/0145985 | A1* | 7/2006 | Hwang et al. | 345/92 |
| 2007/0164957 | A1 | 7/2007 | Hsieh et al. | |
| 2007/0176905 | A1 | 8/2007 | Shih et al. | |
| 2008/0001877 | A1* | 1/2008 | Kim et al. | 345/87 |
| 2008/0150928 | A1 | 6/2008 | Van Der Hoef et al. | |
| 2008/0231620 | A1* | 9/2008 | Hector et al. | 345/208 |

FOREIGN PATENT DOCUMENTS

| | | | |
|---|---|---|---|
| CN | 101241286 | A | 8/2008 |
| KR | 20050018749 | A | 2/2005 |
| TW | 200537427 | A | 11/2005 |
| TW | 200615670 | A | 5/2006 |
| TW | 200727231 | A | 7/2007 |

OTHER PUBLICATIONS

English Translation of the International Preliminary Report on Patentability mailing date Oct. 26, 2012; International Application No. PCT/CN2011/072939.

Extended European Search Report; dated Oct. 18, 2013; Appln. No./Patent No. 11768452.2-1904 2560156 PCT/CN2011072939.

Korean Office Action dated Dec. 30, 2013; Appln. No. 10-2011-7030599.

Korean Notice of Allowance dated Jul. 30, 2014; Appln. No. 10-2011-7030599.

* cited by examiner

COMMON ELECTRODE DRIVING METHOD, COMMON ELECTRODE DRIVING CIRCUIT AND LIQUID CRYSTAL DISPLAY

TECHNICAL FIELD

The present invention relates to a common electrode driving method, a common electrode driving circuit and a liquid crystal display.

BACKGROUND

A liquid crystal display is a display of flat panel type commonly used at present, of which a thin film transistor liquid crystal display (TFT-LCD) has become a mainstream product.

In related arts, the liquid crystal display includes an array substrate and a color-filter substrate, in which the array substrate comprises a plurality of pixels arranged thereon in a matrix form, and each of the pixels includes a pixel electrode and a thin film transistor (TFT) connected to the pixel electrode as a switching element. With a common electrode located on the array substrate or on the color-filter substrate, the pixel electrode forms a liquid crystal capacitance, which applies electrical field to liquid crystal material. In addition, the pixel electrode may form a storage capacitance with a storage electrode formed on the array substrate so as to supplement the liquid crystal capacitance.

FIG. 1 is a schematic diagram for equivalent circuit of a unit pixel of the liquid crystal display in related arts. As shown in FIG. 1, when a TFT-LCD is in operation, on the array substrate, the gate ON voltage is firstly applied to a gate electrode g connected to gate line Gn and the TFT is switched on, thus a data voltage on a data line Dm for displaying an image signal is applied to the drain electrode d through the source electrode s. The drain electrode d is connected to a pixel electrode p, and the above data voltage is applied to the pixel electrode p through the drain electrode d so that a pixel electrode voltage is formed, where Cn is a storage electrode line. On the color-filter substrate, there is disposed a common electrode layer, and a voltage difference between the pixel electrode voltage on the pixel electrode p and the common electrode voltage V0 on the common electrode layer gives rise to a liquid crystal capacitance Clc, which is applied to liquid crystal molecules to make liquid crystal molecules orientated. Since a parasitic capacitance Cgd is formed between the gate electrode g and the drain electrode d, a sharp fluctuation in voltage when the gate line Gn is turned on and off is applied to the pixel electrode p with this parasitic capacitance Cgd, so that a kickback voltage $\Delta Vp$ is generated on the pixel electrode voltage, thus accuracy of the pixel electrode voltage is influenced and a screen flicker is caused.

SUMMARY

In an embodiment of the invention, there is provided a common electrode driving method, comprising: generating a first common electrode signal to be applied to a storage electrode line of each row of pixels on an array substrate, and a second common electrode signal to be applied to a common electrode forming a liquid crystal capacitance with pixel electrodes of each row of pixels on the array substrate, the first common electrode signal being opposite to a gate signal applied to the corresponding row of pixels in terms of transition timing; and inputting the first common electrode signal to each row of pixels, and inputting the second common electrode signal to the common electrode.

In another embodiment of the invention, there is provided a common electrode driving circuit, comprising: a driving signal generation circuit for generating a first common electrode signal to be applied to a storage electrode line of each row of pixels on an array substrate, and a second common electrode signal to be applied to a common electrode forming a liquid crystal capacitance with pixel electrodes of each row of pixels on the array substrate, the first common electrode signal being opposite to a gate signal applied to the corresponding row of pixels in terms of transition timing; and a common electrode signal output terminal for inputting the first common electrode signal to each row of pixels, and inputting the second common electrode signal to the common electrode.

In a further embodiment of the invention, there is provided a liquid crystal display, comprising: a liquid crystal panel; and a driver for driving the liquid crystal panel, wherein the liquid crystal panel is made by assembling an array substrate and a color-filter substrate with a liquid crystal layer filled therebetween, the driver comprising a gate driver, a data driver and a common electrode driver; wherein the common electrode driver is used for generating a first common electrode signal to be applied to a storage electrode line of each row of pixels on the array substrate, and a second common electrode signal to be applied to a common electrode forming a liquid crystal capacitance with pixel electrodes of each row of pixels on the array substrate, and inputting the generated first common electrode signal to each row of pixels respectively and inputting the generated second common electrode signal to the common electrode; and wherein the first common electrode signal is opposite to a gate signal applied to the corresponding row of pixels in terms of transition timing.

DETAILED DESCRIPTION

Figure 1:
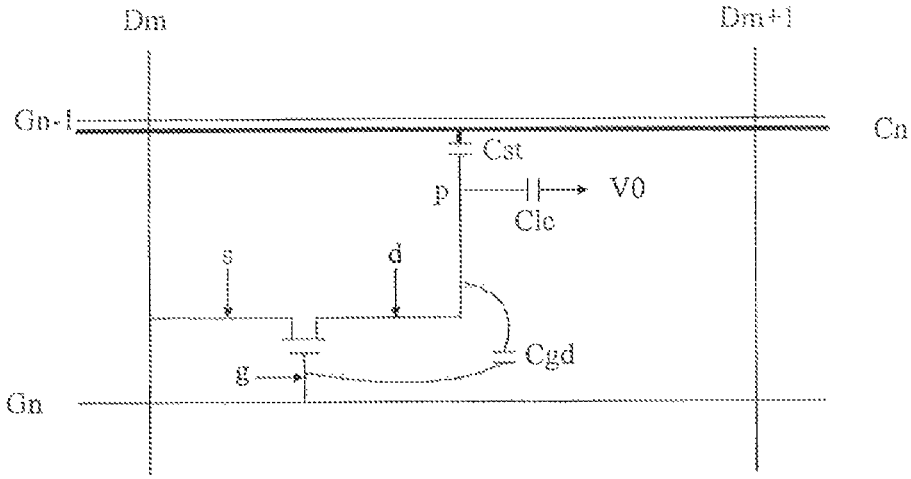
FIG.1 (PRIOR ART)
FIG. 1 is a schematic diagram for equivalent circuit of a unit pixel of the liquid crystal display in related arts.

To make objectives, technical solutions and advantages provided by embodiments of present invention more clearly, a clear and full description will be made to the technical solutions of embodiments of present invention hereinafter in connection with the accompanying drawings of present embodiments. Apparently, rather than all the embodiments, embodiments to be described is only a part of embodiments of present invention. Based on the embodiments of present invention, all the other embodiments acquired by those skilled in the art without making creative work belong to the scope claimed by present invention.

A first embodiment of common electrode driving method according to the invention comprises steps as follows.

In step 201, a first common electrode signal for rows of pixels on an array substrate and a second common electrode signal on a color-filter substrate are generated, the first common electrode signal being opposite to a gate signal for a corresponding row of pixels in terms of transition timing, and absolute value of charge change amount in the storage capacitance due to the transition of the first common electrode signal being equal to that of charge change amount in a parasitic capacitance due to the transition of the gate signal but change directions of them being opposite to each other. The first common electrode signal is applied to a storage electrode line on the array substrate forming a storage capacitance with a pixel electrode, and the storage electrode line can be also referred to as storage common electrode line to which a common electrode signal is applied.

The origination for generation of the kickback voltage ΔVp on the pixel electrode lies in existence of the parasitic capacitance Cgd which is caused from the overlap between the gate electrode of TFT as a switching element of pixel and the drain electrode thereof. When an OFF voltage is inputted to the gate line, the amount of the charges Qgd stored in the parasitic capacitance Cgd is changed, and at this moment, since the sum of charges stored in liquid crystal capacitance Clc formed by the pixel electrode and the common electrode therebetween, storage capacitance Cst formed in the overlap between the pixel electrode and the storage electrode line, and the parasitic capacitance Cgd is in conservation, a change in the charges Qgd stored in the parasitic capacitance Cgd causes a change in charge distribution on the overall pixel electrode, and voltage applied to the pixel electrode is changed and a kickback voltage ΔVp is generated on the pixel electrode. A research shows an expression of kickback voltage ΔVp=Cgd(Vgh−Vgl)/(Cgd+Clc+Cst), where Vgh is ON voltage of gate electrode, and Vgl is OFF voltage of gate electrode. The liquid crystal capacitance is used to drive the orientation of liquid crystal for displaying. Together with the pixel electrode, the common electrode can be formed on array substrate (that is, an LCD of horizontal electric field type, such as IPS or FFS-type LCD) or color-filter substrate which is disposed in opposite to the array substrate (that is, an LCD of vertical electric field type, such as TN-type LCD). In this embodiment, the common electrode is formed on the color-filter substrate, for example. The storage capacitance is used to supplement the liquid crystal capacitance, and enables the liquid crystal capacitance to be stably operated for displaying. The drain of the TFT, which is connected to the pixel electrode, transmits data signal on data line connected to the source of the TFT to the pixel electrode when the TFT is turned on. The TFT can be of a bottom-gate type, a top-gate type, or a combination of both, and the gate electrode and the source and drain electrodes are formed with a gate insulation layer and a semiconductor layer separated therebetween.

Figure 2:
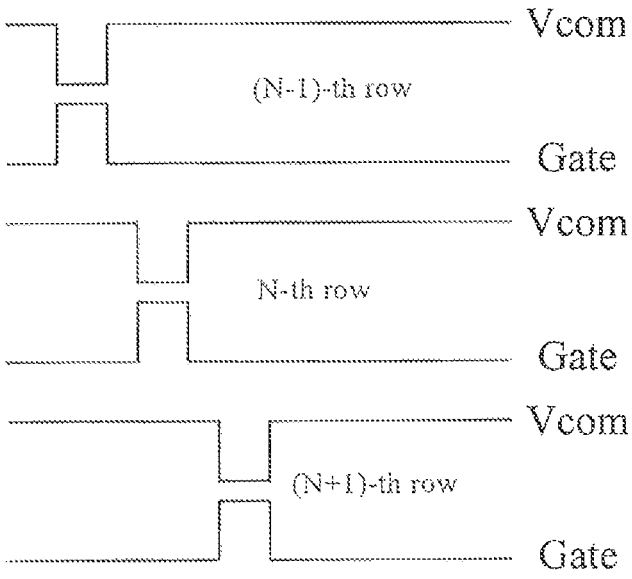
FIG. 2 is a timing chart for a relationship between the first common electrode signal and the gate signal in a first embodiment of common electrode driving method according to the invention.

FIG. 2 is a timing chart for a relationship between the first common electrode signal and the gate signal in a first embodiment of common electrode driving method according to the invention. As shown in FIG. 2, the first common electrode signal Vcom applied to the storage electrode line and the gate signal Gate corresponding to a same row of pixels are opposite to each other in terms of transition timing; that is, when the gate signal is at a high level, the first common electrode signal is at a low level, and when the gate signal is at a low level, the first common electrode signal is at a high level. That is also to say, when the gate line is turned on, the storage electrode line is turned off, and when the gate line is turned off, the storage electrode line is turned on.

The inventors have conducted a deep analysis and study on mechanism of kickback voltage generated by the pixel electrode, and found that when the OFF voltage is applied to the gate line, the total amount of charges stored in the liquid crystal capacitance Clc, the storage capacitance Cst and the parasitic capacitance Cgd before the TFT is turned off is same as the total amount thereof after the TFT is turned off.

Before the TFT is turned off, the charge amount stored in the parasitic capacitance Cgd can be expressed as $$Qgd1=Cgd(Vp1-Vgh),$$

after the TFT is turned off, the charge amount stored in the parasitic capacitance Cgd is expressed as $$Qgd2=Cgd(Vp2-Vgl),$$

thus a change of the charges stored in the parasitic capacitance Cgd upon turning off of the TFT, that is ΔQgd, is expressed as $$\begin{aligned}\Delta Qgd &= Qgd2 - Qgd1\\ &= Cgd[(Vp2 - Vgl) - (Vp1 - Vgh)]\\ &= Cgd(\Delta Vp + Vgh - Vgl),\end{aligned}$$

where Vp1 is the voltage of the pixel electrode immediately before the TFT is turned off, V2 is the voltage of the pixel electrode immediately after the TFT is turned off, and ΔVp=Vp2−Vp1.

When an ON voltage is applied to the storage electrode line at this row, the amount of the charges stored in the storage capacitance Cst before it is turned on is expressed as $$Qst1=Cst(Vp1-Vcl),$$

the amount of the charges stored in the storage capacitance Cst after it is turned on is expressed as $$Qst2=Cst(Vp2-Vch),$$

thus a change in the charges stored in the storage capacitance Cst upon turning on of the TFT, that is ΔQgd, is expressed as $$\begin{aligned}\Delta Qst &= Qst2 - Qst1\\ &= Cst[(Vp2 - Vch) - (Vp1 - Vcl)]\\ &= Cst(\Delta Vp + Vcl - Vch),\end{aligned}$$

where Vch is a voltage with which the storage electrode line is turned on, and Vcl is a voltage with which the storage electrode line is turned off.

In this embodiment, since the transition timing for the first common electrode signal is opposite to that of the gate signal for the corresponding row of pixels, and absolute value of the charge change amount due to the transition of first common electrode signal in the storage capacitance is equal to that of charge change amount in a parasitic capacitance due to the transition of the gate signal but the change directions of them are opposite to each other, that is, the first common electrode signal generated in the this embodiment can enable a relation of ΔQgd=−ΔQst, and at the same time, the sum of the charges stored in the liquid crystal capacitance Clc, the storage capacitance Cst, and parasitic capacitance Cgd is in conservation, thus there is a relation of ΔQlc+ΔQgd+ΔQst=0, hence ΔQlc=0, where ΔQlc is the charge change amount upon turning off of the gate, and ΔQlc=Clc(Vp2−Vp1). Since the liquid crystal capacitance Clc is a constant, relations of Vp2=Vp1 and ΔVp=Vp2−Vp1=0 stand. That is, there is no change occurred to the pixel voltage upon turning off of the gate. The reason thereof is that the change amount of the charges stored in the parasitic capacitance Cgd upon turning off of the TFT, that is, ΔQd, and the change amount of the charges stored in the storage capacitance Cst upon turning on of the storage electrode line are the same in magnitude and opposite to in change direction, thus total change of the charges stored in the two capacitance become zero, and changes in the charges stored in the two capacitances are offset with each other. Therefore, the change amount in the charges on the pixel electrode become zero, and hence a kickback voltage ΔVp on the pixel electrode become zero. However, those skilled in the art can realize that, even if the change amount of the charges stored in the parasitic capacitance Cgd, that is ΔQd, is not completely the same as that of the charges stored in the storage capacitance Cst, that is ΔQst, this embodiment can also function to reduce kickback voltage ΔVp on the pixel voltage upon turning off of the gate, thus display quality of the liquid crystal display is improved.

It should be noted that, in this embodiment, it is possible to superpose a transition timing signal on the basis of a constant common electrode signal to be inputted to the array substrate and the color-filter substrate generated by the related art, so as to generate a first common electrode signal to be inputted to the array substrate, while a second common electrode signal to be inputted to the color-filter substrate is still maintained as the original constant common electrode signal.

In step 202, the first common electrode signal is inputted to the rows of pixels, and the second common electrode signal is inputted to the color-filter substrate.

After generation of the first common electrode signal required by rows of pixels on the array substrate and the second common electrode signal on the color-filter substrate respectively, a driving circuit can correspondingly input the first common electrode signal to rows of pixels and input the second common electrode signal to the color-filter substrate. In this embodiment, the first common electrode signal generated in step 201 is inputted to the rows of pixels, so that kickback voltage ΔVp will not be generated on the pixel electrodes. Thereby, accuracy of pixel electrode voltage is ensured and a screen flicker is avoided.

For this embodiment, with the transition timing of the first common electrode signal inputted to the rows of pixels being specified to be opposite to that of the gate signal for a corresponding row of pixels, and with the absolute value of the charge change amount in the storage capacitance due to the transition of first common electrode signal being equal to that of the charge change amount in the parasitic capacitance due to the transition of the gate signal but the change directions of them being opposite to each other, changes in the charges stored in the parasitic capacitance and storage capacitance are offset with each other and the charge change amount on the pixel electrode become zero, so that kickback voltage on the pixel electrode become zero. Thereby, accuracy of pixel electrode voltage is ensured and a screen flicker is avoided.

In a second embodiment of the common electrode driving method according to present invention, the storage capacitance Cst can be of a structure in which it is provided on the storage electrode line (Cst On Common). That is, the storage capacitance is formed by overlapping the pixel electrode with the storage electrode line. In addition, the common electrode, with which the pixel electrode forms a liquid crystal capacitance, is formed on the color-filter substrate disposed in opposite to the array substrate. The method of this embodiment can include steps as follows.

In step 401, the first common electrode signal for rows of pixels on an array substrate and the second common electrode signal on the color-filter substrate are generated, the first common electrode signal being opposite to the gate signal for a corresponding row of pixels in terms of transition timing, and a difference between the high level and the low level of the first common electrode signal being equal to [Cgd*(Vgh−Vgl)]/Cst, where Cgd is the capacity value of the parasitic capacitance, Cst is the capacity value of the storage capacitance, and Vgh and Vgl are an ON voltage and an OFF voltage of the gate electrode, respectively.

In this embodiment, in order to make the charge change amount in the storage capacitance due to the transition of the first common electrode signal equal to the charge change amount in the parasitic capacitance due to the transition of gate line, a difference between the high level and the low level of the first common electrode signal is specified to be equal to [Cgd*(Vgh−Vgl)]/Cst.

Specifically, upon turning off of the gate signal, that is, upon transition of the storage electrode line, a sum of charges stored in the liquid crystal capacitance Clc, the storage capacitance Cst and the parasitic capacitance Cgd is in conservation, that is Qp1=Qp2, where Qp1 is a sum of charges stored in these three capacitances before the transition of the gate signal, and Qp2 is a sum of charges stored in these three capacitances after the transition of the gate signal.

$$\begin{aligned} Qp1 &= Qlc1 + Qst1 + Qgd1 \\ &= Clc(Vp1 - V0) + Cst(Vp1 - Vcl) + Cgd(Vp1 - Vgh); \end{aligned}$$

$$\begin{aligned} Qp2 &= Qlc2 + Qst2 + Qgd2 \\ &= Clc(Vp2 - V0) + Cst(Vp2 - Vch) + Cgd(Vp2 - Vgl); \end{aligned}$$

Here, therefore, $Clc(Vp1-V0)+Cst(Vp1-Vcl)+Cgd(Vp1-Vgh)=Clc(Vp2-V0)+Cst(Vp2-Vch)+Cgd(Vp2-Vgl)$;

that is, $Clc(Vp2-Vp1)+Cst(Vp2-Vp1+Vcl-Vch)+Cgd(Vp2-Vp1+Vgh-Vgl)=0$;

which also is, $(Clc+Cst+Cgd)(Vp2-Vp1)+Cst(Vcl-Vch)+Cgd(Vgh-Vgl)=0$;

for $(Vch-Vcl)=Cgd(Vgh-Vgl)/Cst$;

$(Clc+Cst+Cgd)(Vp2-Vp1)=0$;

and for $(Clc+Cst+Cgd)\neq 0$;

$Vp2-Vp1=0$, that is, $\Delta Vp=0$.

In step 402, the first common electrode signal is inputted to the rows of pixels, and the second common electrode signal is inputted to the color-filter substrate.

In this embodiment, the first common electrode signal generated in step 401 is inputted to the rows of pixels, so that the kickback voltage ΔVp will not be generated on the pixel electrodes. Thereby, accuracy of pixel electrode voltage is ensured and a screen flicker is avoided.

In this embodiment, with the transition timing of the first common electrode signal inputted to the rows of pixels being specified to be opposite to that of the gate signal for a corresponding row of pixels, and a difference between the high level and the low level of the first common electrode signal being equal to [Cgd*(Vgh−Vgl)]/Cst, changes in the charges stored in parasitic capacitance and storage capacitance are offset with each other and the charge change amount on the pixel electrode become zero, thus a kickback voltage on the pixel electrode become zero. Thereby, accuracy of pixel electrode voltage is ensured and a screen flicker is avoided.

In a third embodiment of common electrode driving method according to present invention, the storage capacitance Cst can be of a structure in which it is provided on the storage electrode line and the gate line (Cst On Common+Cst On Gate). That is, the storage capacitance is formed by overlapping the pixel electrode with both the storage electrode line and the gate line. The common electrode, with which the liquid crystal capacitance is formed, is formed on the color-filter substrate disposed in opposite to the array substrate. The method of this embodiment can include steps as follows.

In step 501, the first common electrode signal for the rows of pixels on an array substrate and the second common electrode signal on the color-filter substrate are generated, the first common electrode signal being opposite to the gate signal for a corresponding row of pixels in terms of transition timing, and a difference between the high level and the low level of the first common electrode signal being equal to [Cgd*(Vgh−Vgl)]/Cst1, where Cgd is the capacity value of the parasitic capacitance, Cst1 is the capacity value of a part of the storage capacitance on the storage electrode line, and Vgh and Vgl are an ON voltage and an OFF voltage of the gate electrode, respectively.

For the case in which, between the pixel electrode and the storage electrode line as well as between the pixel electrode and the gate line, there are formed the storage capacitance Cst, the storage capacitance Cst can be divided into two parts of Cst1 and Cst2 in this embodiment, where Cst1 is a part formed by the storage electrode line, and Cst2 is a part formed by the gate line. Therefore, the capacitances which keep charges in conservation become liquid crystal capacitance Clc, parasitic capacitance Cgd, and Cst1 and Cst2, of which dynamic signals applied by the storage electrode line only influences the part of Cst1. Therefore, the difference between this embodiment and the second embodiment of common electrode driving method according to present invention is that, it is only required to replace Cst in the second embodiment with Cst1 and deem Cst2 to be a part of the liquid crystal capacitance Clc. The principle for implementation thereof is the same as that of the second embodiment of common electrode driving method according to present invention, and the description thereof will not be repeated herein.

In step 502, the first common electrode signal is inputted to the rows of pixels, and the second common electrode signal is inputted to the color-filter substrate.

In this embodiment, the first common electrode signal generated in step 501 is inputted to the rows of pixels, so that the kickback voltage ΔVp will not be generated on the pixel electrodes. Thereby, accuracy of pixel electrode voltage is ensured and a screen flicker is avoided.

For this embodiment, with the transition timing of the first common electrode signal inputted to the rows of pixels being specified to be opposite to that of the gate signal for a corresponding row of pixels, and a difference between the high level and the low level of the first common electrode signal being equal to [Cgd*(Vgh−Vgl)]/Cst1, changes in the charges stored in the parasitic capacitance and the storage capacitance are offset with each other and the charge change amount on the pixel electrode become zero, so that kickback voltage on the pixel electrode become zero. Thereby, accuracy of pixel electrode voltage is ensured and a screen flicker is avoided.

Figure 3:
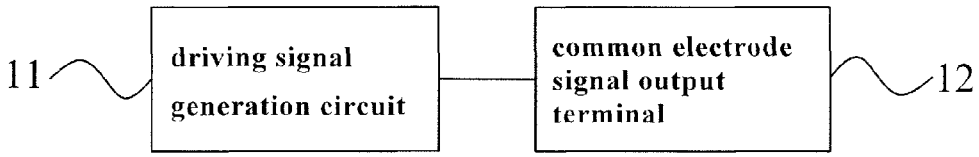
FIG. 3 is a structural diagram of the first embodiment of common electrode driving circuit according to the invention.

FIG. 3 is a structural diagram of a first embodiment of common electrode driving circuit according to the invention. As shown in FIG. 3, the common electrode driving circuit according to this embodiment comprises a driving signal generation circuit 11 and a common electrode signal output terminal 12. The driving signal generation circuit 11 is used for generating a first common electrode signal for rows of pixels on the array substrate and a second common electrode signal on the color-filter substrate, the first common electrode signal being opposite to the gate signal for a corresponding row of pixels in terms of transition timing, and the charge change amount in the storage capacitance due to the transition of first common electrode signal is equal to the charge change amount in the parasitic capacitance due to the transition of the gate signal; and the common electrode signal output terminal 12 is used for inputting the first common electrode signal to the rows of pixels, and inputting the second common electrode signal to the common electrode on the color-filter substrate.

The common electrode driving circuit according to this embodiment can be included in an existing common electrode driving circuit. Those skilled in the art can design a specific circuit implementation by themselves in accordance with functions implemented by the common electrode driving circuit according to this embodiment, and a description thereof will not be given herein.

The common electrode driving circuit according to this embodiment can be used to carry out the first embodiment of common electrode driving method, and principle for implementation thereof is similar, thus a description thereof will not be repeated herein.

For the common electrode driving circuit according to this embodiment, with the transition timing of the first common electrode signal inputted to the rows of pixels being specified to be opposite to that of the gate signal for a corresponding row of pixels, and the charge change amount in the storage capacitance due to the transition of first common electrode signal being equal to the charge change amount in the parasitic capacitance due to the transition of the gate signal, changes in the charges stored in the parasitic capacitance and in storage capacitance are offset with each other and charge change amount on the pixel electrode become zero, thus a kickback voltage on the pixel electrode become zero. Thereby, accuracy of pixel electrode voltage is ensured and a screen flicker is avoided.

In a second embodiment of common electrode driving circuit according to this invention, the structure thereof also can be configured by the circuit structure shown in FIG. 3. Further, in this embodiment, storage capacitance Cst has a structure in which the pixel electrode is overlapped with the storage electrode line, and a difference between the high level and the low level of the first common electrode signal generated by the driving signal generation circuit 11 is equal to [Cgd*(Vgh−Vgl)]/Cst, where Cgd is the capacity value of the parasitic capacitance, Cst is the capacity value of the storage capacitance, and Vgh and Vgl are ON voltage and OFF voltage of the gate electrode, respectively.

The common electrode driving circuit according to this embodiment can be used to carry out the method of the second embodiment of common electrode driving method, and principle for implementation thereof is similar, thus a description thereof will not be repeated herein.

For the common electrode driving circuit according to this embodiment, with the transition timing of the first common electrode signal inputted to the rows of pixels being specified to be opposite to that of the gate signal for a corresponding row of pixels, and a difference between the high level and the low level of the first common electrode signal being equal to [Cgd*(Vgh−Vgl)]/Cst, changes in the charges stored in the parasitic capacitance and storage capacitance are offset with each other and the charge change amount on the pixel electrode become zero, thus a kickback voltage on the pixel electrode become zero. Thereby, accuracy of pixel electrode voltage is ensured and a screen flicker is avoided.

In a third embodiment of common electrode driving circuit according to this invention, the structure thereof also can be configured by the circuit structure shown in FIG. 3. Further, in this embodiment, the storage capacitance has a structure in which the pixel electrode is respectively overlapped with the storage electrode line and the gate line, and a difference between the high level and the low level of the first common electrode signal generated by the driving signal generation circuit 11 is equal to [Cgd*(Vgh−Vgl)]/Cst1, where Cgd is the capacity value of the parasitic capacitance, Cst1 is the capacity value of a part of the storage capacitance on the storage electrode line, and Vgh and Vgl are ON voltage and OFF voltage of the gate electrode, respectively.

The common electrode driving circuit according to this embodiment can be used to carry out the method of third embodiment of common electrode driving method, and principle for implementation thereof is similar, thus a description thereof will not be repeated herein.

For the common electrode driving circuit according to this embodiment, with the transition timing of the first common electrode signal inputted to the rows of pixels being specified to be opposite to that of the gate signal for a corresponding row of pixels, and a difference between the high level and the low level of the first common electrode signal being equal to [Cgd*(Vgh−Vgl)]/Cst1, changes in the charges stored in the parasitic capacitance and storage capacitance are offset with each other and charge change amount on the pixel electrode become zero, thus a kickback voltage on the pixel electrode become zero. Thereby, accuracy of pixel electrode voltage is ensured and a screen flicker is avoided.

Figure 4:
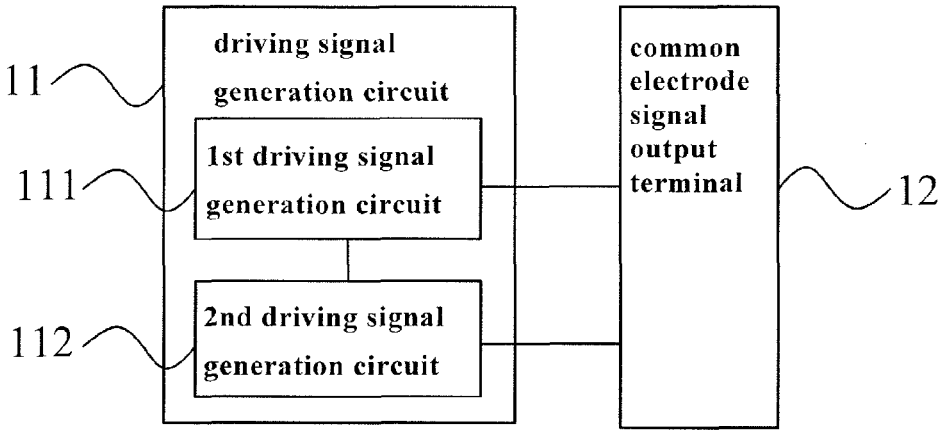
FIG. 4 is a structural diagram of a fourth embodiment of common electrode driving circuit according to the invention.

FIG. 4 is a structural diagram of a fourth embodiment of common electrode driving circuit according to the invention. As shown in FIG. 4, the common electrode driving circuit according to this embodiment is configured on the basis of the first embodiment of the common electrode driving circuit shown in FIG. 3, and further, the driving signal generation circuit 11 includes a first driving signal generation unit 111 and a second driving signal generation unit 112. The first driving signal generation unit 111 is used for generating the second common electrode signal; and the second driving signal generation unit 112 is used for generating the first common electrode signal for the rows of pixels on the array substrate by generating a transition timing signal and superposing the transition timing signal on the second common electrode signal generated by the first driving signal generation unit, the first common electrode signal being opposite to the gate signal for a corresponding row of pixels in terms of transition timing, and the charge change amount in the storage capacitance due to the transition of the first common electrode signal being equal to that of the charge change amount due to the transition of the gate signal.

In this embodiment, on the basis of the related arts, it is possible to use the second driving signal generation unit 112 to generate the transition timing signal and superpose the transition timing signal on the second common electrode signal generated by the first driving signal generation unit 111 and inputted to the color-filter substrate, and thereby to generate the first common electrode signal to be inputted to the array substrate, so that the first common electrode signal is opposite to the gate signal for a corresponding row of pixels in terms of transition timing, and the charge change amount in the storage capacitance due to the transition of first common electrode signal is equal to that of the charge change amount due to the transition of the gate signal. Therefore, changes in the charges stored in the parasitic capacitance and storage capacitance are offset with each other, and the charge change amount on the pixel electrode become zero, thus a kickback voltage on the pixel electrode become zero. Thereby, accuracy of pixel electrode voltage is ensured and a screen flicker is avoided. Furthermore, the common electrode driving circuit according to this embodiment only needs a small modification to that in the related arts, and implementation thereof is convenient.

Figure 5:
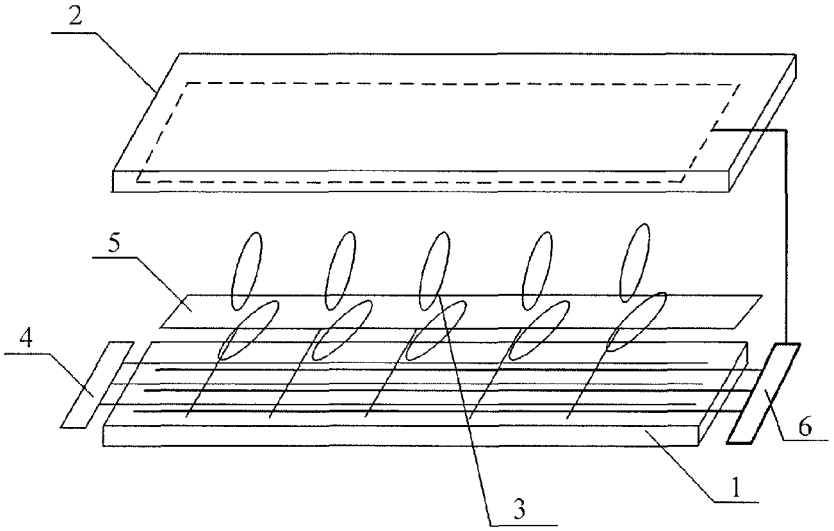
FIG. 5 is a structural diagram of a first embodiment of a liquid crystal display according to the invention.

FIG. 5 is a structural diagram of a first embodiment of a liquid crystal display according to the invention. As shown in FIG. 5, the liquid crystal display according to this embodiment includes a liquid crystal panel and a driver for driving the liquid crystal panel. The liquid crystal panel is made by assembling an array substrate 1 and a color-filter substrate 2 with a liquid crystal layer 3 filled therebetween. The driver comprises a gate driver 4, a data driver 5 and a common electrode driver 6. The common electrode driver 6 is used for generating a first common electrode signal for the rows of pixels on the array substrate 1 and a second common electrode signal on the color-filter substrate 2, and inputting the generated first common electrode signal to the rows of pixels respectively and inputting the generated second common electrode signal to the common electrode on the color-filter substrate. The first common electrode signal is opposite to a gate signal for a corresponding row of pixels in terms of transition timing, and the charge change amount in the storage capacitance due to the transition of the first common electrode signal is equal to that of the charge change amount due to the transition of the gate signal.

In the liquid crystal display according to this embodiment, the first common electrode signal is opposite to the gate signal for a corresponding row of pixels in terms of transition timing, and the charge change amount in the storage capacitance due to the transition of first common electrode signal is equal to the charge change amount in the parasitic capacitance due to the transition of the gate signal. That is, the first common electrode signal generated in the this embodiment can enable a relation of $\Delta Qgd=-\Delta Qst$, and at the same time, a sum of charges stored in the liquid crystal capacitance Clc, the storage capacitance Cst, and parasitic capacitance Cgd is in conservation, thus there is relation of $\Delta Qlc+\Delta Qgd+\Delta Qst=0$, hence $\Delta Qlc=0$, where $\Delta Qlc$ is charge change amount upon turning off of the gate, and $\Delta Qlc=Clc(Vp2-Vp1)$. Since the liquid crystal capacitance Clc is a constant, it comes to relation of $Vp2=Vp1$, and thus $\Delta Vp=Vp2-Vp1=0$. That is, there is no change occurred to the pixel voltage upon turning off of the gate. The reason thereof is that the change amount of the charges stored in the parasitic capacitance Cgd upon turning off of the TFT, that is, $\Delta Qd$, and the change amount of the charges stored in the storage capacitance Cst upon turning on of the storage electrode line are the same in magnitude and opposite in change direction, thus total change of the charges stored in the two capacitance become zero, and changes in the charges stored in the two capacitances are offset with each other. Therefore, change amount in charges on the pixel electrode become zero, and hence a kickback voltage $\Delta Vp$ on the pixel electrode become zero.

It should be noted that, the common electrode driving circuit 6 according to this embodiments can be implemented with the common electrode driving circuit shown in FIG. 3 or FIG. 4, and a description thereof will not be repeated herein.

For the liquid crystal display according to this embodiment, with the transition timing of the first common electrode signal inputted to the rows of pixels being specified to be opposite to that of the gate signal for a corresponding row of pixels, and the charge change amount in the storage capacitance due to the transition of first common electrode signal being equal to the charge change amount in the parasitic capacitance due to the transition of the gate signal, changes in the charges stored in the parasitic capacitance and the storage capacitance are offset with each other, and the charge change amount on the pixel electrode become zero, thus a kickback voltage on the pixel electrode become zero. Thereby, accuracy of pixel electrode voltage is ensured and a screen flicker is avoided.

In a second embodiment of the liquid crystal display according to this invention, the structure thereof also can be configured by the structure shown in FIG. 5. Further, in this embodiment, the storage capacitance Cst has a structure in which the pixel electrode is overlapped with the storage electrode line, and a difference between the high level and the low level of the first common electrode signal generated by the common electrode driving circuit 6 is equal to [Cgd*(Vgh−Vgl)]/Cst, where Cgd is the capacity value of the parasitic capacitance, Cst is the capacity value of the storage capacitance, and Vgh and Vgl are an ON voltage and an OFF voltage of the gate electrode, respectively.

The liquid crystal display according to this embodiment can be used to carry out the method of the second embodiment of common electrode driving method, and the principle for implementation thereof is similar, thus the description thereof will not be repeated herein.

For the liquid crystal display according to this embodiment, with the transition timing of the first common electrode signal inputted to the rows of pixels being specified to be opposite to that of the gate signal for a corresponding row of pixels, and a difference between the high level and the low level of the first common electrode signal being equal to [Cgd*(Vgh−Vgl)]/Cst, changes in the charges stored in the parasitic capacitance and the storage capacitance are offset with each other and charge change amount on the pixel electrode become zero, thus a kickback voltage on the pixel electrode become zero. Thereby, accuracy of pixel electrode voltage is ensured and a screen flicker is avoided.

In a third embodiment of the liquid crystal display according to this invention, the structure thereof also can be configured by the structure shown in FIG. 5. Further, in this embodiment, the storage capacitance Cst has a structure in which the pixel electrode is respectively overlapped with the storage electrode line and the gate line, and a difference between the high level and the low level of the first common electrode signal generated by the common electrode driving circuit 6 is equal to [Cgd*(Vgh−Vgl)]/Cst1, where Cgd is the capacity value of the parasitic capacitance, Cst1 is the capacity value of a part of the storage capacitance on the storage electrode line, and Vgh and Vgl are an ON voltage and an OFF voltage of the gate electrode, respectively.

The liquid crystal display according to this embodiment can be used to carry out the method of the third embodiment of common electrode driving method, and the principle for implementation thereof is similar, thus the description thereof will not be repeated herein.

For the liquid crystal display according to this embodiment, with the transition timing of the first common electrode signal inputted to the rows of pixels being specified to be opposite to that of the gate signal for a corresponding row of pixels, and a difference between the high level and the low level of the first common electrode signal being equal to [Cgd*(Vgh−Vgl)]/Cst1, changes in the charges stored in the parasitic capacitance and storage capacitance are offset with each other and the charge change amount on the pixel electrode become zero, thus a kickback voltage on the pixel electrode become zero. Thereby, accuracy of pixel electrode voltage is ensured and a screen flicker is avoided.

Those skilled in the art can understand that, the steps for implementing the above embodiments can be fully or partly realized by software, hardware, firmware or the like in association with a program. The aforementioned program can be stored in a computer readable storage medium. When executed, the program executes the steps involving the embodiments of above methods, and the aforementioned storage medium include a various of medium that can store program codes, such as ROM, RAM, diskette or optical disc and the like.

Finally, it should be explained that, the above embodiments are only used for explaining the technical solution of present invention, and not for limitation thereto. Although the present invention has been explained in details with reference to the preferred embodiments, it should be understood by those skilled in the art that modifications and equivalent alternations may be made to the technical solution of present invention, and these modifications and equivalent alternations can not depart the modified technical solution from the spirit and scope of the technical solution of present invention.

What is claimed is:

1. A common electrode driving method, comprising:

inputting the first common electrode signal to each row of pixels, and inputting the second common electrode signal to the common electrode, wherein the first common electrode signal and the gate signal applied to the corresponding row of pixels are transited synchronously and a polarity of a difference between a level of the first common electrode signal after the transition and a level of the first common electrode signal before transition is opposite to a polarity of a difference between a level of the gate signal applied to the corresponding row of pixels after the transition and a level of the gate signal applied to the corresponding row of pixels before transition, wherein the first common electrode signal and the second common electrode signal are generated by a driving signal generation circuit, and the driving signal generation circuit comprises: a first driving signal generation unit for generating the second common electrode signal; and a second driving signal generation unit for generating the first common electrode signal by generating a transition timing signal and superposing the transition timing signal on the second common electrode signal generated by the first driving signal generation unit.

2. The common electrode driving method according to claim 1, wherein an absolute value of a charge change amount due to the transition of the first common electrode signal in a storage capacitance is equal to that of a charge change amount due to the transition of the gate signal in a parasitic capacitance connected in series with a storage capacitance, and change directions of them are opposite to each other.

3. The common electrode driving method according to claim 2, wherein the storage capacitance has a structure in which the pixel electrode is overlapped with the storage electrode line, and a difference between a high level and a low level of the first common electrode signal is equal to [Cgd*(Vgh−Vgl)]/Cst, where Cgd is a capacity value of the parasitic capacitance connected in series with the storage capacitance, Cst is a capacity value of the storage capacitance, and Vgh and Vgl are an ON voltage and an OFF voltage of a gate electrode, respectively.

4. The common electrode driving method according to claim 2, wherein the storage capacitance has a structure in which the pixel electrode is respectively overlapped with the storage electrode line and the gate line, and a difference between a high level and a low level of the first common electrode signal is equal to [Cgd*(Vgh−Vgl)]/Cst1, where Cgd is a capacity value of the parasitic capacitance connected in series with the storage capacitance, Cst1 is a capacity value of a part of the storage capacitance on the storage electrode line, and Vgh and Vgl are an ON voltage and an OFF voltage of a gate electrode, respectively.

5. The common electrode driving method according to claim 1, wherein the common electrode is formed on a color-filter substrate or the array substrate.

6. A common electrode driving circuit, comprising:

a common electrode signal output terminal for inputting the first common electrode signal to each row of pixels, and inputting the second common electrode signal to the common electrode, wherein the first common electrode signal and the gate signal applied to the corresponding row of pixels are transited synchronously and a polarity of a difference between a level of the first common electrode signal after the transition and a level of the first common electrode signal before transition is opposite to a polarity of a difference between a level of the gate signal applied to the corresponding row of pixels after the transition and a level of the gate signal applied to the corresponding row of pixels before transition, wherein the driving signal generation circuit comprises:

a first driving signal generation unit for generating the second common electrode signal; and a second driving signal generation unit for generating the first common electrode signal by generating a transition timing signal and superposing the transition timing signal on the second common electrode signal generated by the first driving signal generation unit.

7. The common electrode driving circuit according to claim 6, wherein an absolute value of a charge change amount due to the transition of the first common electrode signal in a storage capacitance is equal to that of a charge change amount due to the transition of the gate signal in a parasitic capacitance connected in series with a storage capacitance, and change directions of them are opposite to each other.

8. The common electrode driving circuit according to claim 7, wherein the storage capacitance has a structure in which the pixel electrode is overlapped with the storage electrode line, and a difference between a high level and a low level of the first common electrode signal generated by the driving signal generation circuit is equal to [Cgd*(Vgh−Vgl)]/Cst, where Cgd is a capacity value of the parasitic capacitance connected in series with the storage capacitance, Cst is a capacity value of the storage capacitance, and Vgh and Vgl are an ON voltage and an OFF voltage of a gate electrode, respectively.

9. The common electrode driving circuit according to claim 7, wherein the storage capacitance has a structure in which the pixel electrode is respectively overlapped with the storage electrode line and the gate line, and a difference between a high level and a low level of the first common electrode signal generated by the driving signal generation circuit is equal to [Cgd*(Vgh−Vgl)]/Cst1, where Cgd is a capacity value of the parasitic capacitance connected in series with the storage capacitance, Cst1 is a capacity value of a part of the storage capacitance on the storage electrode line, and Vgh and Vgl are an ON voltage and an OFF voltage of a gate electrode, respectively.

10. A liquid crystal display, comprising:

a liquid crystal panel; and a driver for driving the liquid crystal panel, wherein the liquid crystal panel is formed by assembling an array substrate and a color-filter substrate with a liquid crystal layer filled therebetween, the driver comprising a gate driver, a data driver and a common electrode driver, wherein the common electrode driver is used for generating a first common electrode signal to be applied to a storage electrode line of each row of pixels on the array substrate, and a second common electrode signal to be applied to a common electrode forming a liquid crystal capacitance with pixel electrodes of each row of pixels on the array substrate, and inputting the generated first common electrode signal to each row of pixels and inputting the generated second common electrode signal to the common electrode, and wherein the first common electrode signal is opposite to a gate signal applied to gate electrodes in the corresponding row of pixels in terms of transition timing, wherein the first common electrode signal and the gate signal applied to the corresponding row of pixels are transited synchronously and a polarity of a difference between a level of the first common electrode signal after the transition and a level of the first common electrode signal before transition is opposite to a polarity of a difference between a level of the gate signal applied to the corresponding row of pixels after the transition and a level of the gate signal applied to the corresponding row of pixels before transition, wherein the common electrode driver, comprises:

a first driving signal generation unit for generating the second common electrode signal; and a second driving signal generation unit for generating the first common electrode signal by generating a transition timing signal and superposing the transition timing signal on the second common electrode signal generated by the first driving signal generation unit.

11. The liquid crystal display according to claim 10, wherein an absolute value of a charge change amount due to the transition of the first common electrode signal in a storage capacitance is equal to that of a charge change amount due to the transition of the gate signal in the parasitic capacitance connected in series with the storage capacitance, and change directions of them are opposite to each other.

12. The liquid crystal display according to claim 11, wherein the storage capacitance has a structure in which the pixel electrode is overlapped with the storage electrode line, and a difference between a high level and a low level of the first common electrode signal is equal to [Cgd*(Vgh−Vgl)]/Cst, where Cgd is a capacity value of the parasitic capacitance connected in series with the storage capacitance, Cst is a capacity value of the storage capacitance, and Vgh and Vgl are an ON voltage and an OFF voltage of a gate electrode, respectively.

13. The liquid crystal display according to claim 11, wherein the storage capacitance has a structure in which the pixel electrode is respectively overlapped with the storage electrode line and the gate line, and a difference between a high level and a low level of the first common electrode signal is equal to [Cgd*(Vgh−Vgl)]/Cst1, where Cgd is a capacity value of the parasitic capacitance connected in series with the storage capacitance, Cst1 is a capacity value of a part of the storage capacitance on the storage electrode line, and Vgh and Vgl are an ON voltage and an OFF voltage of a gate electrode, respectively.

14. The liquid crystal display according to claim 10, wherein the common electrode is formed on the color-filter substrate or the array substrate.

* * * * *